US007584855B2

(12) United States Patent
Rutstrom

(10) Patent No.: US 7,584,855 B2
(45) Date of Patent: Sep. 8, 2009

(54) CONTAINER AND METHOD FOR TIE-LESS STORAGE AND TRANSPORT OF SECURED CONTENTS

(75) Inventor: Lawrence L. Rutstrom, Kent, WA (US)

(73) Assignee: Alliance Packaging, LLC, Renton, WA (US)

( * ) Notice: Subject to any disclaimer, the term of this patent is extended or adjusted under 35 U.S.C. 154(b) by 0 days.

(21) Appl. No.: 11/640,451

(22) Filed: Dec. 15, 2006

(65) Prior Publication Data

US 2008/0142514 A1 Jun. 19, 2008

(51) Int. Cl.
*B65D 75/00* (2006.01)
*B65D 73/00* (2006.01)

(52) U.S. Cl. ..... 206/784

(58) Field of Classification Search ..... 53/133.1, 53/133.2, 139.5, 565; 493/52, 84, 87; 206/423, 206/756, 784
See application file for complete search history.

(56) References Cited

U.S. PATENT DOCUMENTS

| | | | | |
|---|---|---|---|---|
| 760,866 | A | 5/1904 | Hohoff | |
| 880,549 | A | 3/1908 | Lord | |
| 1,337,091 | A | 4/1920 | Neski | |
| 1,493,152 | A | 5/1924 | Gardner | |
| 1,606,523 | A | 11/1926 | Gardner | |
| 1,669,617 | A | 5/1928 | Kennedy | |
| 2,682,949 | A | 7/1954 | Whitehead | 206/46 |
| 3,095,086 | A | 6/1963 | Berg | 206/45.19 |
| 3,752,035 | A | 8/1973 | Cozzy et al. | 89/13 R |
| 3,973,356 | A | 8/1976 | Schacht | 47/41 R |
| 4,209,092 | A * | 6/1980 | Jones | 206/423 |
| 4,957,237 | A | 9/1990 | Madonna et al. | 229/120 |
| 5,803,267 | A | 9/1998 | Tu et al. | 206/576 |
| 6,789,678 | B2 | 9/2004 | Auclair | 206/590 |
| 7,219,797 | B2 * | 5/2007 | Kroeze et al. | 206/423 |
| 2002/0179474 | A1 * | 12/2002 | Levieux et al. | 206/423 |
| 2005/0045496 | A1 * | 3/2005 | Jenkins | 206/45.25 |

* cited by examiner

*Primary Examiner*—Rinaldi I. Rada
*Assistant Examiner*—John Paradiso
(74) *Attorney, Agent, or Firm*—Seed Intellectual Property Law Group PLLC

(57) ABSTRACT

A container for tie-less securing and transport of contents includes an inner case member positionable within an interior of an outer case member. The inner case member includes at least two side panels, a top panel, and a base panel, forming a second interior, a collapsed portion of first and second side panels being positioned adjacent each other to form a slot for engaging a portion of the contents and securing the contents therein. The container further includes a closure panel having a retaining flap configured to extend into the interior and including a securing tab and a lip portion, which erects in response to the securing tab pivoting with respect to the retaining flap, forming a barrier configured to rest against and bias the contents into the slot, when the closure panel is in a first closed position.

34 Claims, 10 Drawing Sheets

CONTAINER AND METHOD FOR TIE-LESS STORAGE AND TRANSPORT OF SECURED CONTENTS

BACKGROUND OF THE INVENTION

1. Field of the Invention

The present invention generally relates to containers, and more particularly, to a container for securing and transporting fragile contents.

2. Description of the Related Art

In commercial and private settings, users have long benefited from containers, such as corrugated containers, when shipping goods, gifts, and other items. Furthermore, due to the increasingly interstate and global nature of relationships and businesses, individuals and businesses often communicate through remote gestures and distant dealings, such as shipping goods and/or gifts. Frequently, these items are fragile, as is the case when shipping flowers and breakables. Consequently, senders expend time, money and additional material to secure contents of the container. Accordingly, existing containers include those designed to reduce assembly time and material while better securing the contents.

Some solutions include boxes having a divider that provides some support of the contents. However, even when using these boxes, the contents continue to experience some movement during transport. Consequently, other solutions include ties inserted through tie holes and engaging a portion of the contents as well as being tied to a portion of one of the box sides, further securing the contents in place. This tying process is time-consuming, cumbersome, and costly for individuals and businesses that ship many items, especially fragile items, such as flowers, on a regular basis. For such businesses, saving even a few seconds when assembling each box amounts to a sizeable time and cost savings over a longer duration such as a day, a week or a month.

Additionally, ties such as strings, ribbons, or wires used to secure contents such as flowers also make opening conventional containers difficult. Some ties require large cutting tools, such as industrial scissors, for cutting the ties. Particularly, when the contents are fragile recipients of conventional containers often spend excess time and effort to untie the contents from the box to prevent damaging the contents. Furthermore, tying fragile and delicate contents such as flowers introduces additional opportunity for damaging the contents also during transport of the contents.

Accordingly, there is a need for an improved container that better secures contents of the container for storage and/or transport, can be assembled more efficiently, and minimizes a risk of damage to the contents.

BRIEF SUMMARY OF THE INVENTION

According to one embodiment, a container comprises an outer case member comprising a plurality of side panels forming a first interior, and a first closure panel pivotable with respect to at least one of the side panels between a first position in which the first closure panel closes the first interior and a second position in which the first closure panel opens the first interior, and an inner case member positionable within the first interior and comprising a base panel, a top panel longitudinally opposing the base panel, at least first and second side panels therebetween, and a rear panel, forming a second interior, the rear panel coupled on opposing lateral ends thereof to the first and second side panels at respective first ends of the first and second side panels extending between the top panel and the base panel, the first and second side panels each having a free end opposing the first ends thereof, the first side panel having a first intermediate section positioned between opposing longitudinal ends thereof, and the second side panel having a second intermediate section positioned between opposing longitudinal ends thereof, the first and second intermediate sections being configured to collapse toward each other, a collapsed portion of the first intermediate section being positioned adjacent a collapsed portion of the second intermediate section forming a slot therebetween, the slot dividing the second interior into first and second volumes, a boundary of the slot being formed by the adjacent collapsed portions, the slot engaging a portion of the contents and limiting a space in which the portion of the contents is displaceable, when the contents are placed in the inner case member.

According to another embodiment, a container blank for forming a container comprises an outer case blank configured to form an outer case member comprising a plurality of side panels configured to pivot about a plurality of fold lines to form a first interior of the outer case member, and a first closure panel pivotable with respect to at least one of the side panels between a first position in which the first closure panel closes the first interior and a second position in which the first closure panel opens the first interior, when the outer case blank forms the outer case member, and an inner case blank configured to form an inner case member positionable within the first interior, the inner case blank comprising a base panel, a top panel longitudinally opposing the base panel, a rear panel and at least first and second side panels positioned between the top and base panels, the top panel, base panel and first and second side panels configured to pivot about a top panel fold line, a base panel fold line and at least two side panel fold lines, respectively, to form a second interior, the first side panel having a first intermediate section positioned between opposing longitudinal ends thereof, the second side panel having a second intermediate section positioned between opposing longitudinal ends thereof, the first and second intermediate sections being configured to collapse toward each other when the second interior is formed, a collapsible portion of the first intermediate section being positionable adjacent a collapsible portion of the second intermediate section, forming a slot therebetween, the slot dividing the second interior into first and second volumes, when the inner case blank forms the inner case member, a boundary of the slot being formed by the adjacent collapsed portions, the slot engaging a portion of the contents and limiting a space in which the portion of the contents is displaceable, when the inner case blank forms the inner case member and the contents are placed in the inner case member.

According to yet another embodiment, a method of forming and/or using a container comprises folding a plurality of side panels about a plurality of side panel fold lines of an outer case blank to form a first interior of an outer case member, folding first and second side panels, a base panel and a top panel of an inner case blank about at least two side panel fold lines, a bottom panel fold line and a top panel fold line, respectively, to form a second interior of an inner case member, collapsing a portion of first and second intermediate sections of the first and second side panels, respectively, toward each other, positioning a collapsed portion of the first intermediate section adjacent a collapsed portion of the second intermediate section, forming a slot therebetween configured to secure the contents in the second interior, positioning the inner case member in the first interior, placing the contents in the second interior and securing an intermediate section of the contents in the slot, substantially preventing a displacement of the contents, and folding a first closure panel about a fold line to close the first and second interior.

According to still another embodiment, a container comprises a first side panel having a first intermediate section positioned between opposing longitudinal ends thereof, and a second side panel having a second intermediate section positioned between opposing longitudinal ends thereof, the first and second intermediate sections being configured to collapse toward each other, a collapsed portion of the first intermediate section being positioned adjacent a collapsed portion of the second intermediate section forming a slot therebetween, a boundary of the slot being formed by the adjacent collapsed portions, the slot engaging a portion of the contents and limiting a space in which the portion of the contents is displaceable for securing of the contents, when the contents are placed in the container, and a closure panel pivotable with respect to at least one of the side panels between a first position in which the closure panel closes an interior formed between the first and second side panels and at least a second position in which the closure panel opens the interior, the closure panel comprising a retaining flap pivotably connected to the closure panel toward a free end thereof, the retaining flap being configured to extend into the interior and position adjacent the collapsed portion of the first and second intermediate sections, when the second closure panel is in the first position, the retaining flap comprising a securing tab pivotably connected to the retaining flap toward a free end thereof along a laterally extending fold line and a lip portion bordering the fold line and positioned on a side of the fold line opposing the securing tab, the lip portion erecting in response to the securing tab pivoting with respect to the retaining flap, the retaining flap and the lip portion forming a barrier configured to rest against and bias the contents into the slot, when the closure panel is in the first position.

BRIEF DESCRIPTION OF THE SEVERAL VIEWS OF THE DRAWING(S)

DETAILED DESCRIPTION OF THE INVENTION

Figure 1:
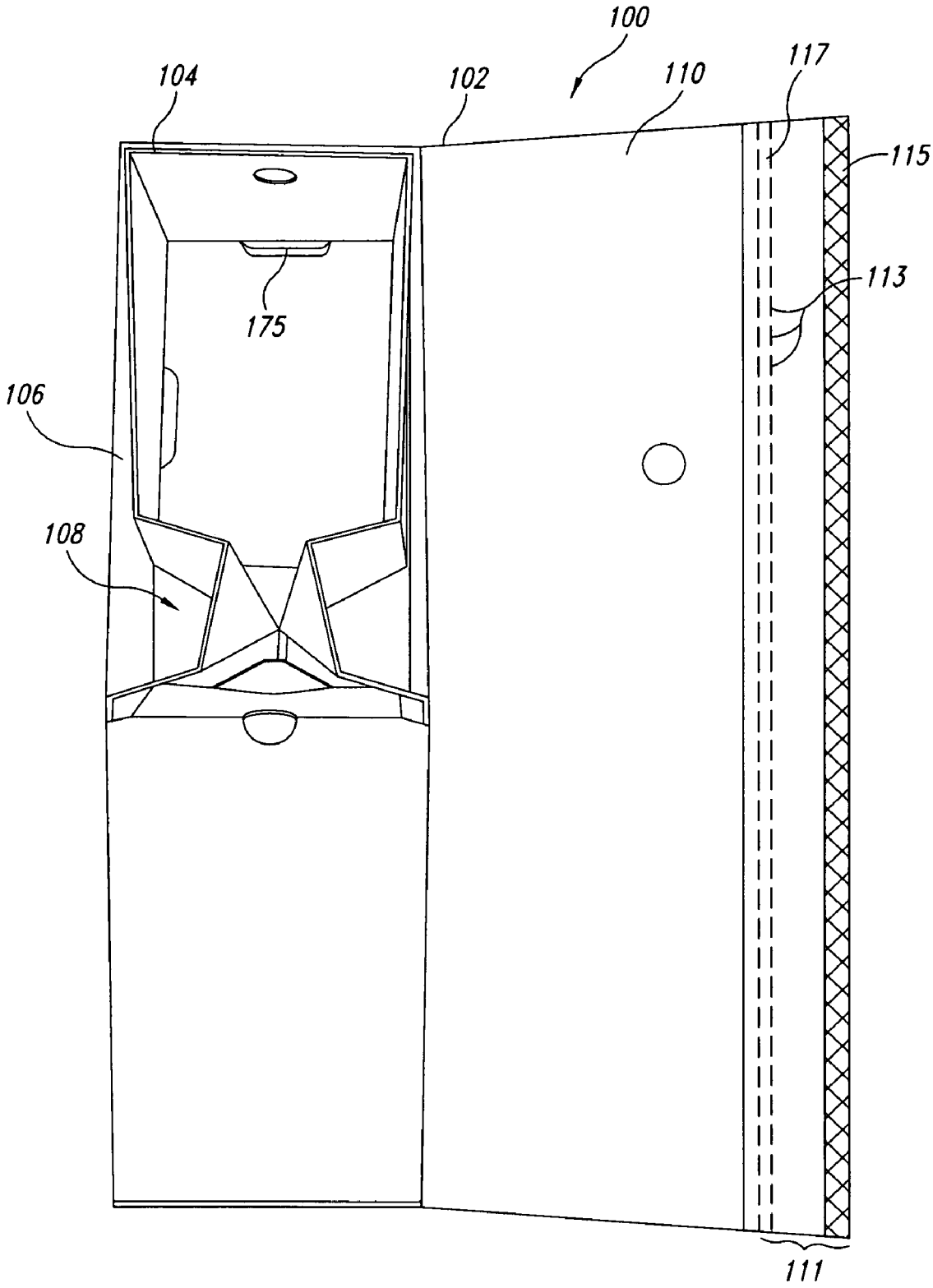
FIG. 1 is a front view of a container according to one embodiment.
Figure 2A:
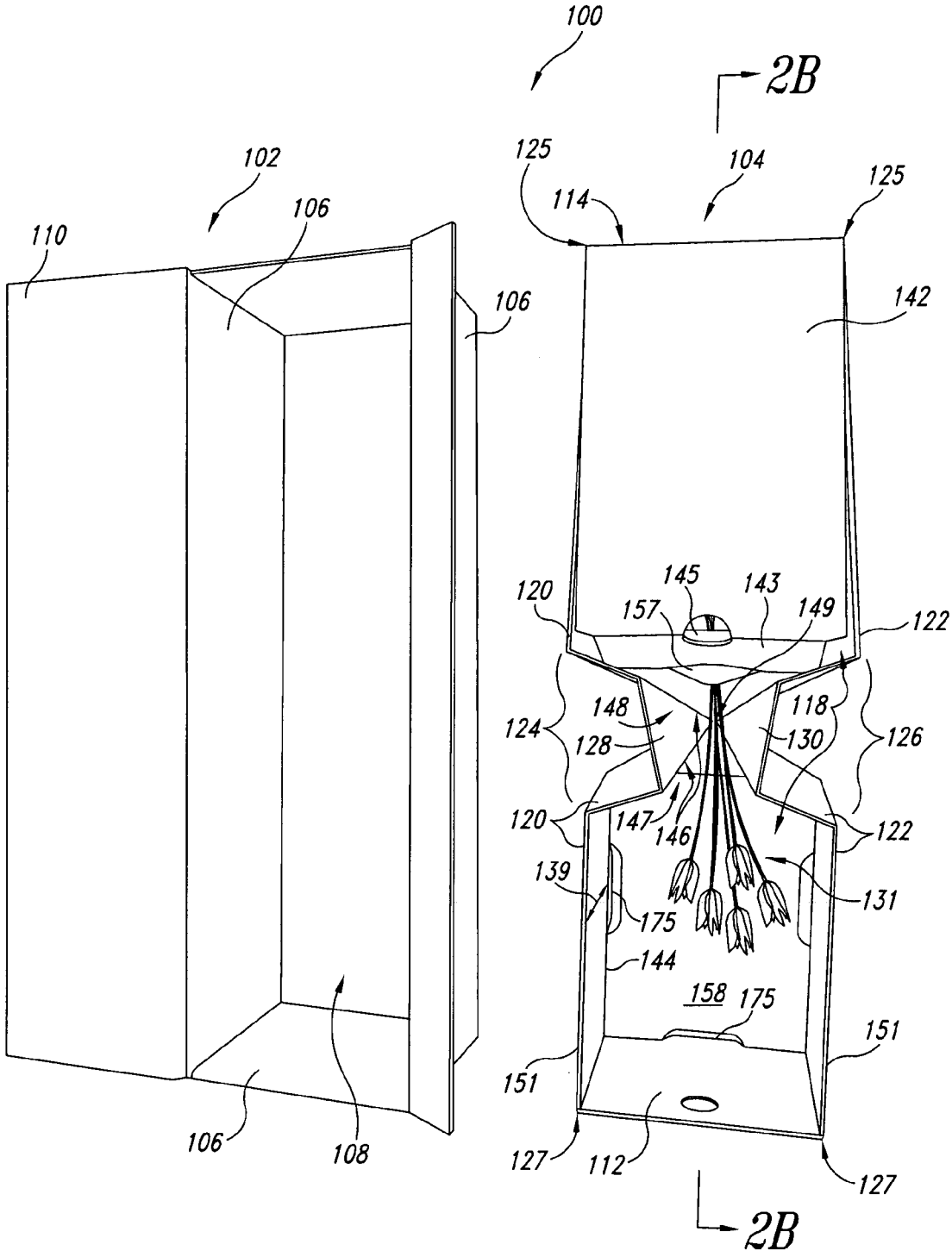
FIG. 2A is a front view of an outer case member and an inner case member of the container of FIG. 1.
Figure 3:
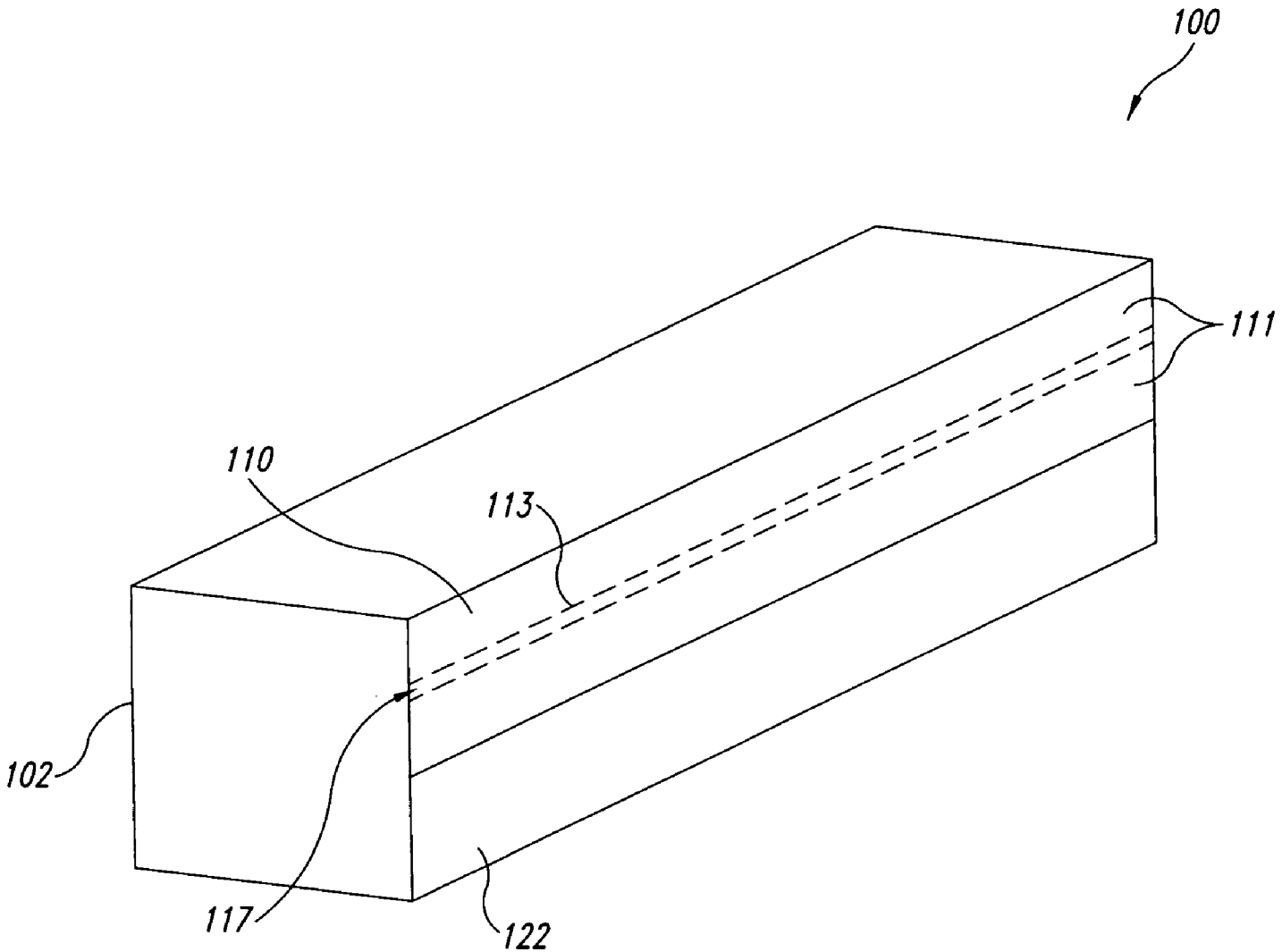
FIG. 3 is a perspective view of the container of FIG. 1.

According to one embodiment, FIG. 1 illustrates a container 100 for tie-less securing and transport of contents. The container 100 includes an outer case member 102 including a first interior 108 and an inner case member 104. The inner case member 104 is positionable within the first interior 108 of the outer case member 102. As illustrated in FIG. 2A, the outer case member 102 comprises a plurality of side panels 106 that form the first interior 108. The outer case member 102 further comprises a first closure panel 110, configured to pivot with respect to at least one of the side panels 106. The first closure panel 110 is pivotable between a first position, illustrated in FIG. 3, and at least a second position, illustrated in FIGS. 1 and 2A. As illustrated in FIG. 3, when the first closure panel 110 is in the first position, the first closure panel 110 closes the first interior 108 (FIG. 2A), and as illustrated in FIGS. 1 and 2A, when in the second position, the first closure panel 110 exposes and/or opens the first interior 108.

As illustrated in FIG. 1, In some embodiments, the first closure panel 110 further includes an extension flap 111 having a coupling member 115 configured to couple the first closure panel 110 to at least one of the side panels 106 and maintain the first closure panel 110 in the first position, shown in FIG. 3. The extension flap 111 may also comprise a tear strip 117 configured to separate the extension flap 111, allowing the first closure panel 110 to pivot to the second position.

For example, the tear strip 117 may comprise a feature 113 such as perforations, a plurality of cut lines, fold lines, creases, any combination thereof and/or any other feature configured to assist a user in separating the extension flap 111, such that the user can pivot the first closure panel 110 to the second position and access the inner case member 104 and/or the contents therein.

The coupling member 115 can comprise hook and loop fasteners, adhesives, magnets, any combination thereof, or any other component, device, compound, and/or attribute that promotes engagement of the extension flap 111 to one of the sides 106. In embodiments where the coupling member 115 includes adhesive, the adhesive can include a double-sided adhesive, a temporary adhesive and/or a temperature sensitive adhesive.

As illustrated in FIG. 2A, the inner case member 104 includes a base panel 112, a top panel 114, a rear panel 158 and at least two side panels 120, 122 forming a second interior 118. The side panels 120, 122 extend longitudinally between the base panel 112 and the top panel 114 and also across a depth 139 of the second interior 118, the depth 139 extending from a free end 151 of the first and second side panels 120, 122 to the rear panel 158. The first side panel 120 includes a first intermediate section 124 and the second side panel 122 includes a second intermediate section 126. Longitudinally, the first and second intermediate sections 124, 126 are positioned between opposing longitudinal ends 125, 127 of the first and second side panels 120, 122, respectively. Each of the first and second intermediate sections 124,126 are configured to collapse inward toward the other of the intermediate sections 124, 126. The term inward as used herein refers to a direction pointing from the side panels 120, 122 toward a center of the second interior 118.

Figure 4A:
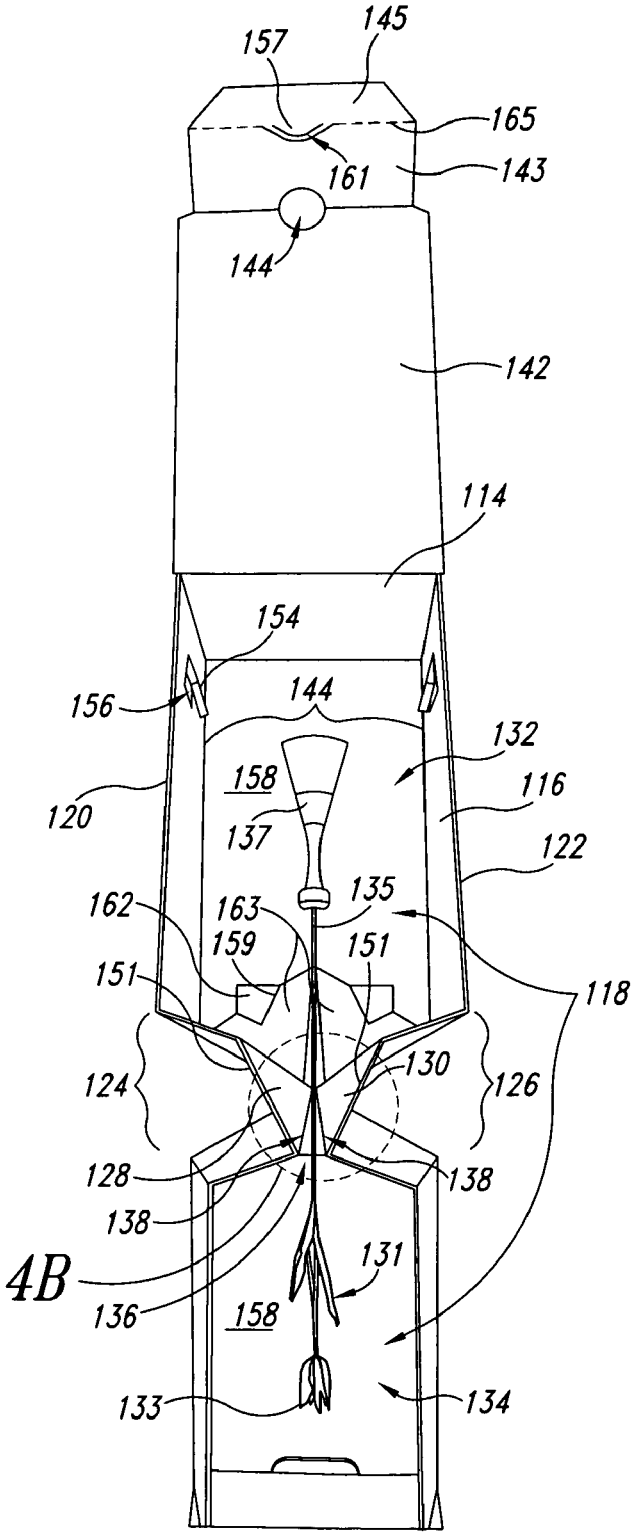
FIG. 4A is a front view of the inner case member of FIG. 2A.

As illustrated in FIG. 4A, the first side panel 120 is positioned laterally opposing the second side panel 122, and the first intermediate section 124 is positioned substantially laterally opposing the second intermediate section 126.

In one embodiment, a collapsed portion 128 of the first intermediate section 124 is positioned adjacent a collapsed portion 130 of the second intermediate section 126, forming a boundary 138 of a slot 136, which divides the second interior 118 into first and second volumes 132, 134.

Figure 4B:
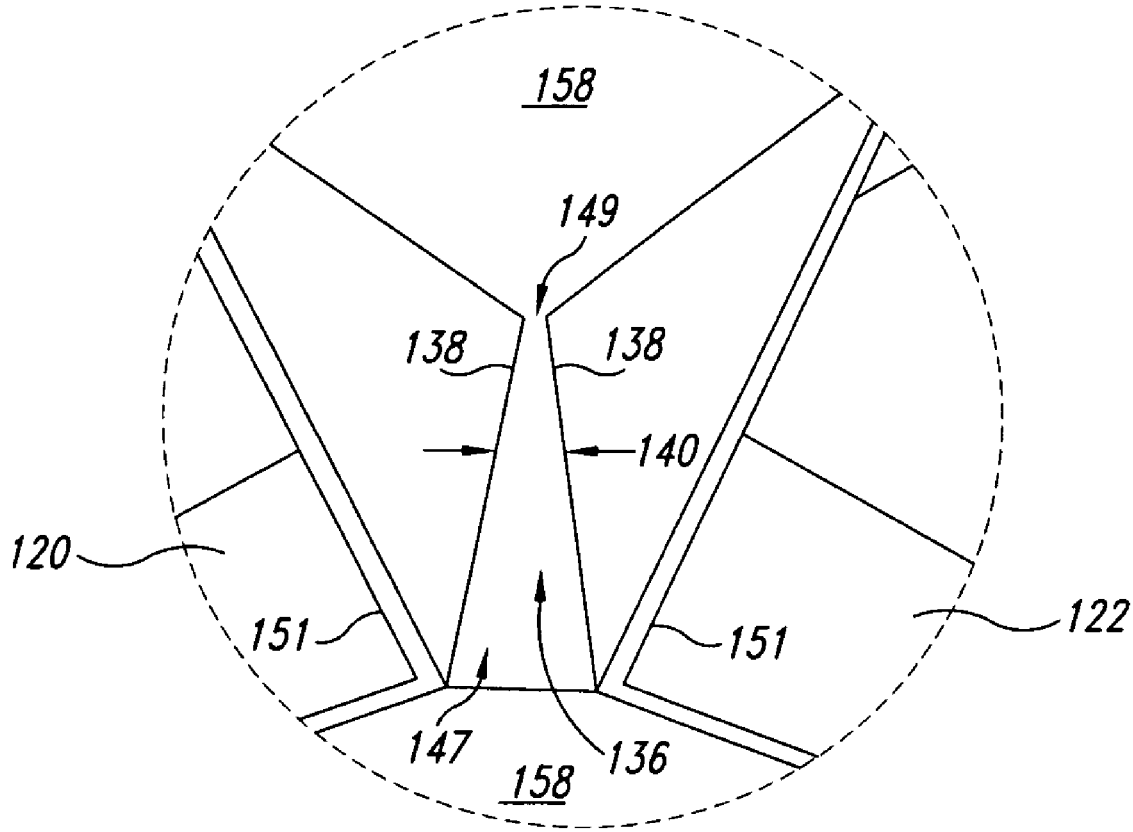
FIG. 4B is a detail view of a portion of the inner case member of FIG. 4A.
Figure 5:
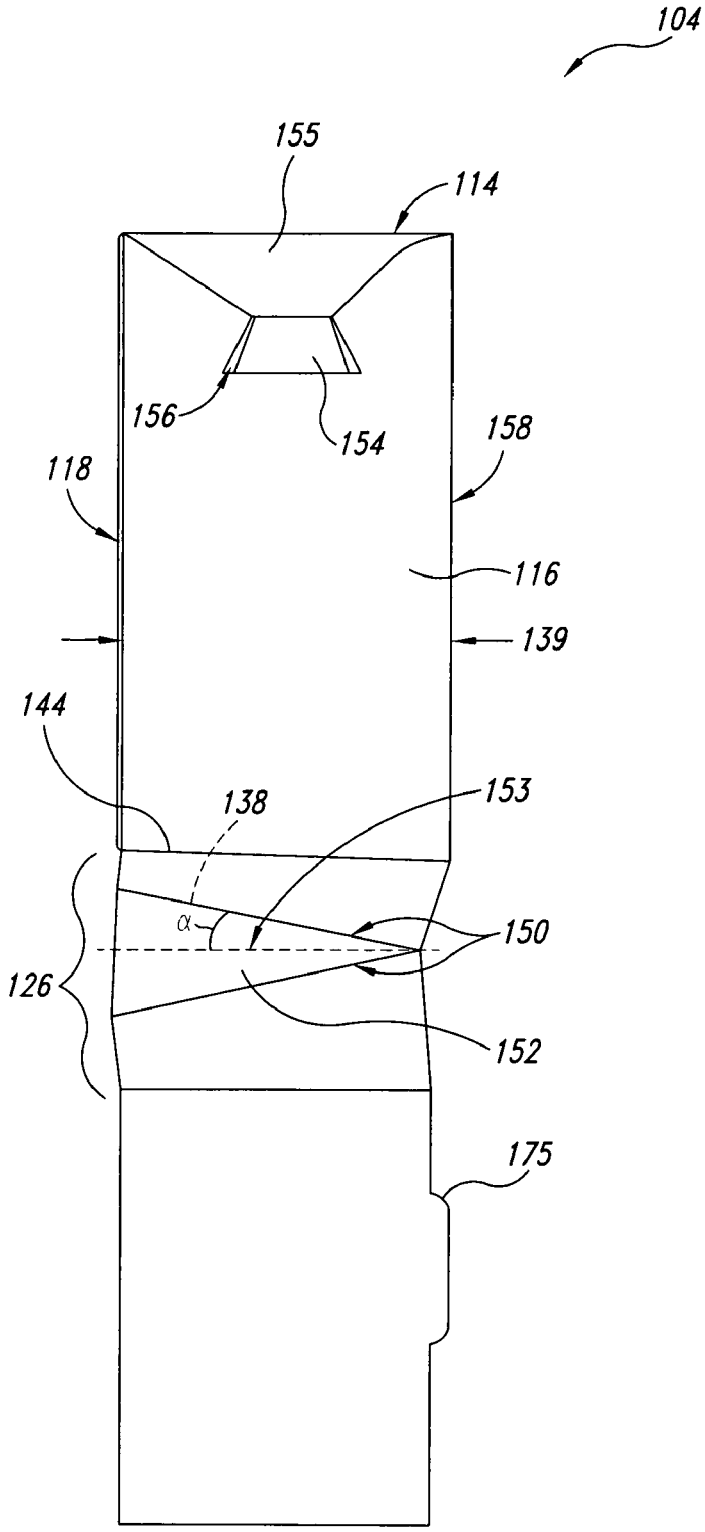
FIG. 5 is a side view of the inner case member of FIG. 2A.

As more clearly apparent in FIG. 4B, the boundary 138 forms a substantially wedge-shaped or triangular-shaped slot 136 that extends along the depth 139 (FIG. 5) of the second interior 118 (FIG. 5). The wedge-shaped slot 136 includes a wide end 147 and a narrow end 149. The wide end 147 is positioned toward the free end 151 of the first and second intermediate portions 124, 126, shown in FIGS. 4A and 4B. The narrow end 149 is positioned toward the rear panel 158. As shown in FIG. 5, the wedge-shape formed by the slot 136 may fall on a plane 153, which is substantially perpendicular to the rear panel 158 or it may be positioned at an angle $\alpha$ with respect to the perpendicular plane 153. As illustrated in FIG. 4A, the slot 136 is configured to securely receive a portion of the contents 131 by limiting a space in which the portion of the contents 131 can displace. For example, in the floral shipping context, the second volume 134 can house a vase or a base 137 in which flowers or plants 131 are placed. The flowers 131 comprise a stem portion 135 and a flower blooms and/or leaved portion 133. The slot 136 is configured to receive a portion of the stem portion 135 and the first volume 132 is configured to house the flower and/or leaved portions 133.

In one embodiment, as shown in FIG. 4B, the slot 136 comprises a substantially rigid tapering profile, such as a "V" shaped profile, such that a width 140 of the slot 136 decreases toward the narrow end 149. Therefore, the contents 131 having different widths can be positioned at different portions of the slot 136, respectively, between the wide end 147 and the narrow end 149 such that they are secured by the boundary 138 of the slot 136. In the example above, the stem portion 135 of the flower 131 can be inserted through the wide end 147 (FIG. 5) of the slot 136 and pushed toward the narrow end 149 until the boundary 138 of the slot 136 applies sufficient pressure to the stem portion 135 to secure the stem portion 135 in place without damaging them.

Accordingly, forming the inner case member 104 also forms the slot 136 for securing at least a portion of the contents 131, such as the stems 135, in the second interior 118, precluding a need for other material or securing members such as tie members. Consequently, the user saves time and money when using the container 100, especially in applications that require forming many containers for shipping items, including fragile items, such as gifts and flowers.

Furthermore, when the inner case member 104 is placed in the first interior 108 and the first closure panel 110 is in the first position as illustrated in FIG. 3, the second interior 118 also closes. Therefore, the first closure panel 110 further secures the contents 131 (FIG. 4A) within the second interior 118, preventing the base 137 and/or the blooms 131 from shifting beyond the bounds of the first and second volumes 132, 134, which also prevents the stem portion 135 from being forced out of the slot 136.

Figure 2B:
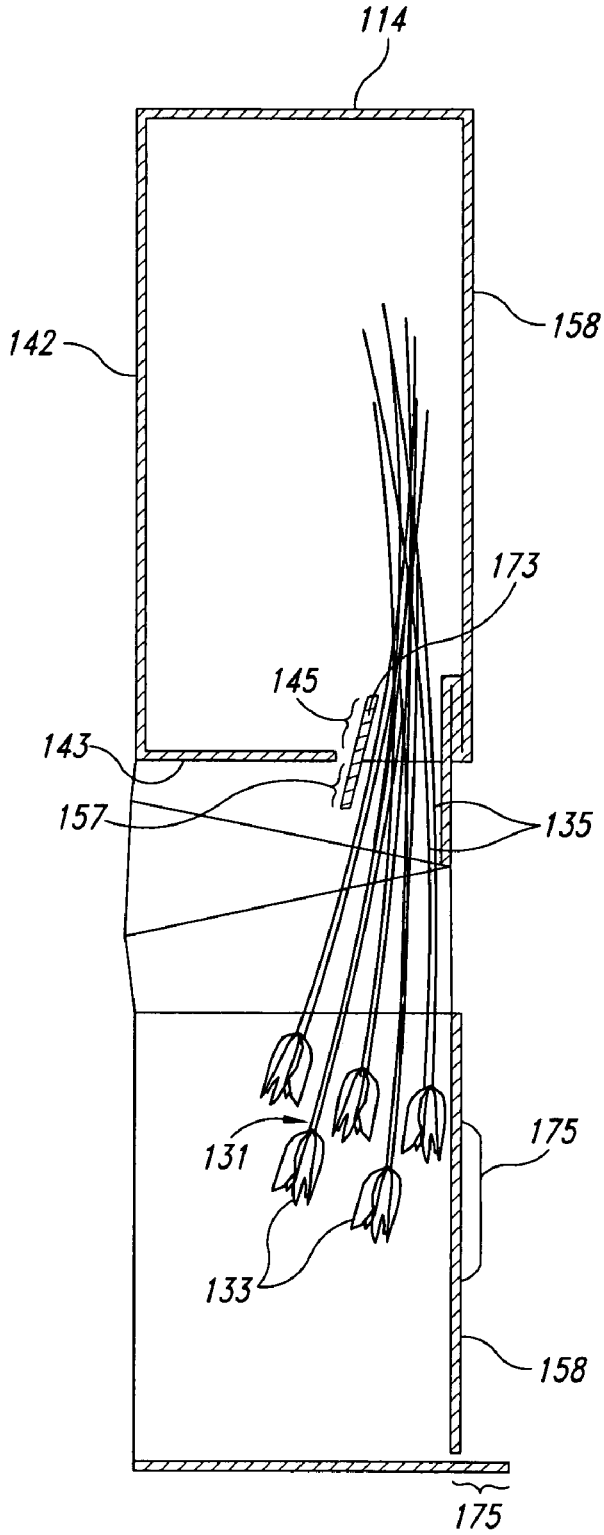
FIG. 2B is a cross-sectional view of the inner case member of FIG. 2A.

In some embodiments, the inner case member 104 may further comprise a second closure panel 142 as illustrated in FIGS. 2A, 2B and 4A. In these embodiments, the second closure panel 142 is pivotable with respect to at least one of the first and second side panels 120, 122, base panel 112 and/or top panel 114, between a first position in which the second closure panel 142 at least partially closes the second interior 118, for example the first volume 132, as illustrated in FIG. 2A, and at least a second position in which the second closure panel 142 exposes and/or opens the portion of the second interior 118 as illustrated in FIG. 4A. The user can pivot the second closure panel 142 to the second position to place the contents or a portion thereof in the second interior 118 or a portion thereof, such as in the first volume 132.

The second closure panel 142 may comprise a retaining flap 143 toward a free end thereof. When the second closure panel 142 is in the first position, the retaining flap 143 is configured to pivot with respect to the closure panel 142 to extend into the second interior 118 and be positioned adjacent the collapsed portions 128, 130 of the first and second intermediate sections 124, 126, as illustrated in FIG. 2A.

As illustrated in FIG. 4A, the retaining flap 143 further comprises a securing tab 145 pivotably connected to the retaining flap 143 and a lip portion 157 separated from the retaining flap 143 along a cut line 161. The lip portion 157 is positioned such that it borders a portion of a lateral fold line 165 about which the securing tab 145 pivots with respect to the retaining flap 143. The lip portion 157 is also situated on an opposing side of the fold line 165 than is the securing tab 145.

As illustrated in FIG. 2A, when the second closure panel 142 is in the first position, the second closure panel 142 is substantially parallel to the rear panel 158. The retaining flap 143 pivots with respect to the second closure panel 142, and extends into the second closure panel 142. Furthermore, the retaining flap 143 does not extend the entire depth 139 (FIG. 5) of the interior 118; rather it extends partially into the second interior 118.

When the securing tab 145 pivots in a first direction toward the top panel 114, the lip portion 157 simultaneously pivots in a second direction, substantially opposite the first direction, toward the base panel 112.

Accordingly, as shown in FIG. 2B, when the contents 131 are placed in the inner case member and the second closure panel 142 is in the first closed position, the securing tab 145 and lip portion 157 form a barrier 173. The barrier 173 rests against the contents 131 and biases the contents 131 or a portion thereof, such as the stems 135, toward the narrow end 149 (FIG. 5) of the slot 136, further preventing potential displacement of the contents 131. The barrier 173 can pivot to varying degrees with respect to the retaining flap 143 to secure contents of varying sizes. For example, the barrier 173 may pivot less when securing stems 135 of a bouquet of flowers 131 as shown in FIG. 2B, as compared to securing the stem 135 of the single flower 131, shown in FIG. 4A.

The barrier 173 and slot 136 minimize or substantially eliminate a risk of damage to the flowers 131 because the barrier 173 and slot 136 secure the flowers 131 across a larger surface area thereof being in contact with portions of the flowers 131. In contrast, conventional ties, such as wires or strings, tend to damage delicate contents such as flowers because they concentrate a force applied to the flowers across a thin width of the wire or string when securing the flowers.

As one of ordinary skill in the art will appreciate, a recipient of a container according to an embodiment of the present invention, such as the container 100 described above, will also benefit from the features described herein. For example, the recipient simply removes the tear strip 117, releasing the extension flap 111, and pivots the first closure panel 110 to the second open position to access the inner case member 104. Furthermore, the recipient pivots the second closure panel 142 to the second open position, lifting the barrier 173 away from the contents 131. Next, the recipient slidably removes the contents 131 or a portion thereof, such as the stems 135 discussed above, from the slot 136 to remove the contents 131 from the container 100 without damaging the contents 100. Therefore, a container according to an embodiment of the present invention, such as the container 100 described above, substantially eliminates a need for external tools, such as scissors, and substantially alleviates risk of damage to the contents 131.

Furthermore, in some embodiments, the inner case member 104 further comprises raising tabs 175 that promote a straight posture of bendable contents, such as the flowers 131. As shown in FIGS. 2B and 5, the raising tabs 175 protrude beyond the rear panel 158. When the rear panel 158 is placed on a surface, such as one of the side panels 106 of the outer container 104 (FIG. 2A), the raising tabs 175 rest on a portion of the surface and raise the rear panel 158 proximate the raising tabs 175. In this manner, blooms 133 resting on the raised portion of the rear panel 158 are also raised, counteracting at least some bending that may occur in the stems 135, for example due to gravity. Therefore, the raising tabs 175 further prevent damage to the flowers 131 while they are stored in the container 100 and/or being transported to their destination.

The container 100 or portions thereof can be fabricated from any material that is formable and can maintain a shape after being formed, such as corrugated paper, cardboard, plastics, composites, and/or any combination thereof. Furthermore, to form the first and second interiors 108, 118, side panels 106, 120, 122, top panel 114, base panel 112 and first and second closure panels 110, 142 comprise at least one feature 144 configured to promote folding the respective panels with respect to other panels to form the inner and outer case members 102, 104. The feature 144 may comprise perforations, at least one crease, cut lines, fold lines, or any other feature configured to promote folding the respective panels with respect to the other panels.

For example, in the illustrated embodiment of FIG. 4A, the first and second intermediate sections 124, 126 each comprise at least one feature 144 configured to promote the collapse of the first and second intermediate sections 124, 126. As illustrated in FIG. 2A, the at least one feature 144 of the first intermediate section 124 forms a border 146 of a first triangular section 148. Similarly, as illustrated in FIG. 5, the feature 144 of the second intermediate section 126 forms at least a portion of a border 150 of a second triangular section 152. The first and second intermediate sections 124, 126 fold at the borders 146, 150 of the first and second triangular sections 148, 152 and at least a portion of the borders 146, 150 form the boundary 138 of the slot 136 (FIG. 4A).

As illustrated in FIGS. 4A and 5, in some embodiments, at least one of the panels of the inner case member 104 may comprise fastening protrusions 154 on opposing sides thereof. Each fastening protrusion 154 is configured to engage a complementary receptacle 156 formed in at least two adjacent panels, thereby coupling the at least one side panel to the at least two adjacent panels and maintaining a shape of a portion of the inner case member 104. For example, the top panel 114 can comprise the fastening protrusions 154 engaging the complementary receptacles 156 in two adjacent side panels 120, 122. In some embodiments, the fastening protrusions 154 couple to the top panel 114 via a flap 155. One side of the inner case member 104 is illustrated in FIG. 5 and the laterally opposing side is substantially identical to the side shown in FIG. 5.

The receptacle 156 can be an opening, a recess, or any other feature that can engage the fastening protrusion 154. Furthermore, the fastening protrusion 154 and receptacle 156 may comprise complementing hook and loop fasteners, adhesives, magnets or any other coupling member, to further engage the fastening protrusions 154 to the receptacle 156, maintaining the shape of the portion of the inner case member 104.

Figure 6:
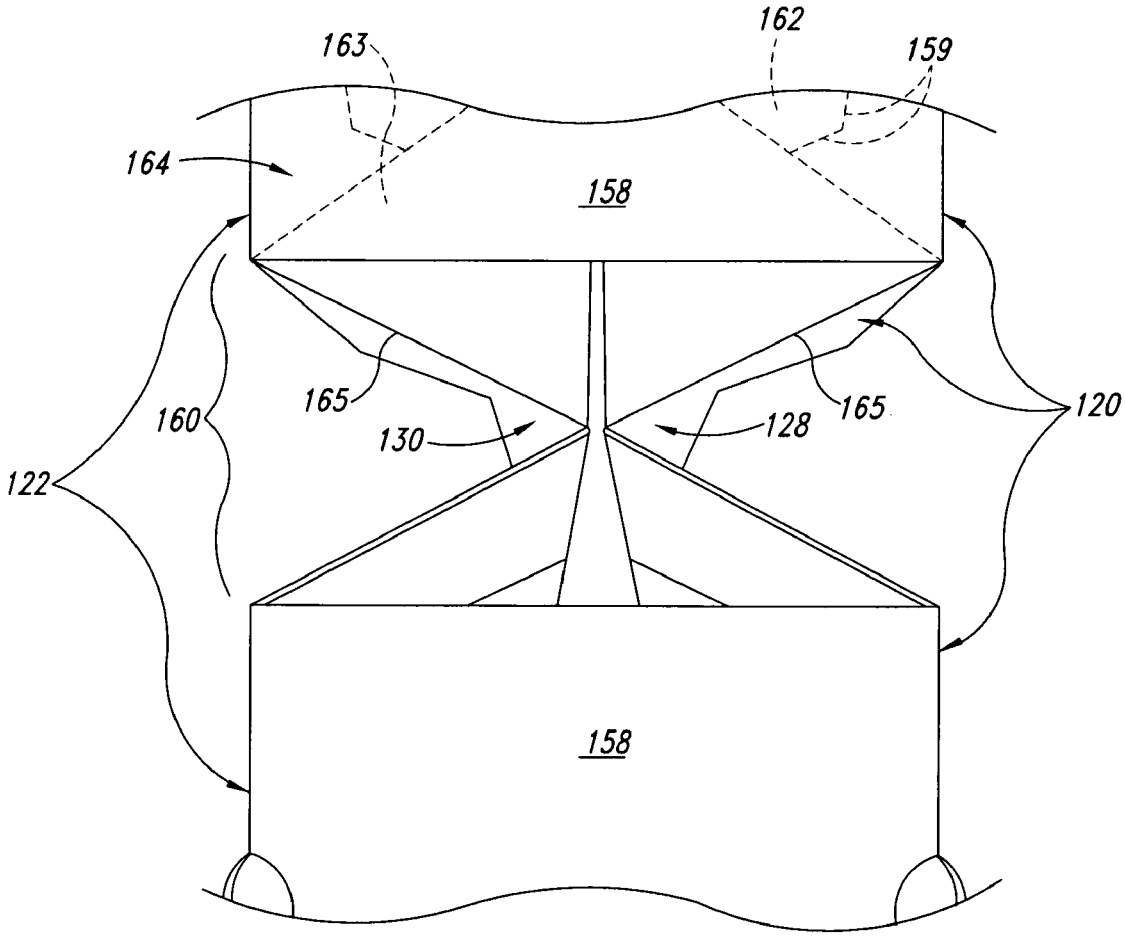
FIG. 6 is a rear view of a portion of the inner case member of FIG. 2A.

As illustrated in FIG. 6, the rear panel 158 is coupled on opposing lateral sides thereof to the first and second side panels 120, 122. The rear panel 158 includes a third intermediate section 160 positioned between longitudinal ends thereof and longitudinally proximate the first and second intermediate sections 124, 126 (FIG. 4A). The third intermediate section 160 includes a first portion 162, more clearly shown in FIG. 4A, and in hidden lines in FIG. 6, which is folded over a second portion 164, shown in FIG. 6. Furthermore, the folded portion 162 comprises slits 159 that allow a third portion 163 of the third intermediate section 160 to fold again at an angle with respect to the first folded portion 162 as shown in FIG. 4A. The third folded portion 163 is connected to the first and second collapsed portions 128, 130 at opposing edges 165 thereof as shown in FIG. 6. In this manner, a portion of the rear panel 158 proximate the slot 136 is thickened, stiffening an intermediate section of the inner case member 104, which includes at least a portion of the first, second and third intermediate sections 124, 126, 160.

Stiffening the intermediate section of the inner case member 104 assists in preventing lateral motion or rotation of the inner case member 104 or a portion thereof. Accordingly, the likelihood of damaging the stems 135 from the boundary 138 of the slot 136 contacting the stems 135 in a leveraging or adverse manner due to displacement or rotation of the intermediate section of the inner case member 104 or a portion thereof, is minimized. To further secure the first, second, and third folded portions 162, 163, 164, a portion of the first folded portion 162 can be adhered to the rear panel 158 using any suitable method, such as adhesives and/or hook and loop fasteners.

Figure 7:
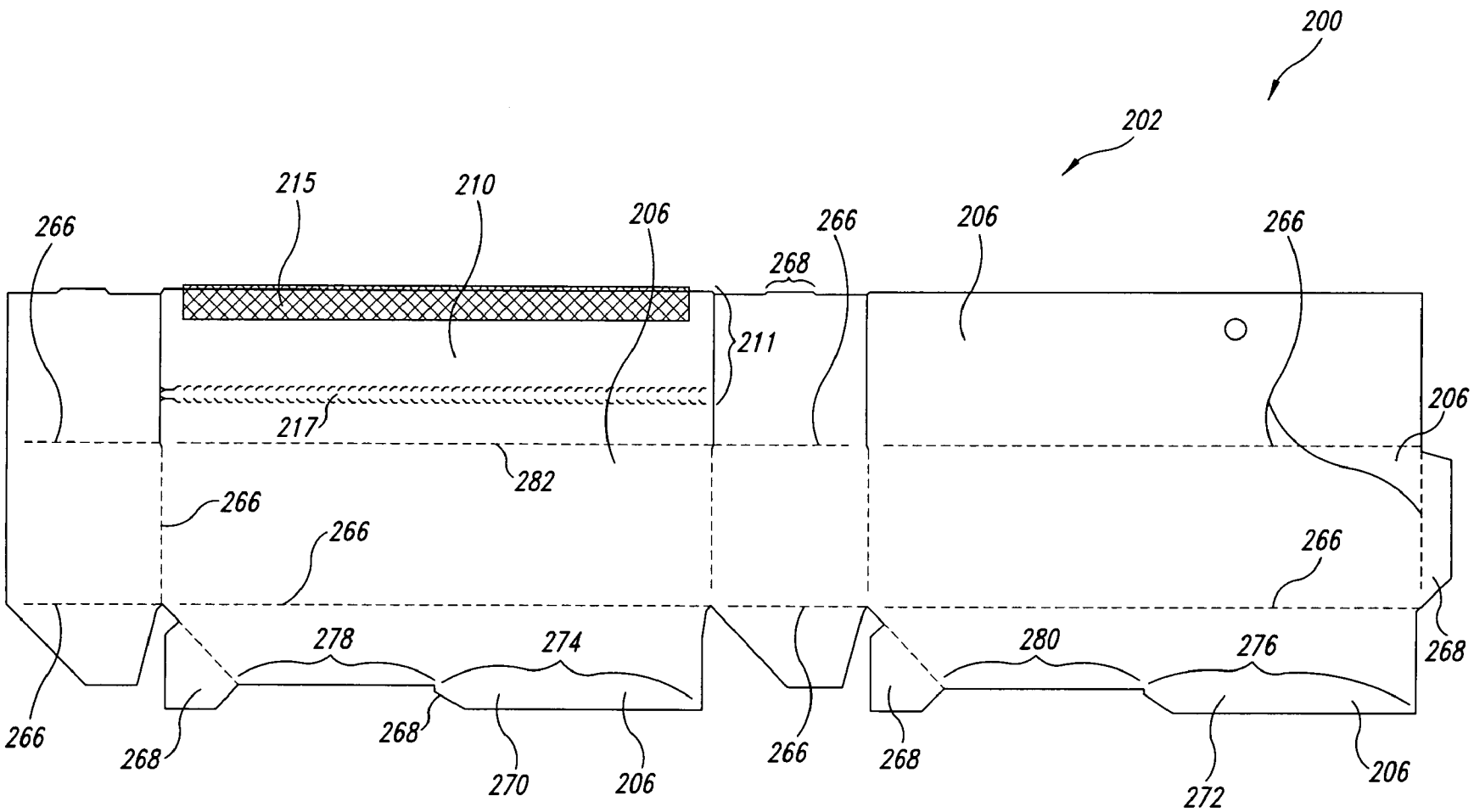
FIG. 7 is a plan view of an outer case blank for forming an outer case member of a container according to one embodiment.
Figure 8:
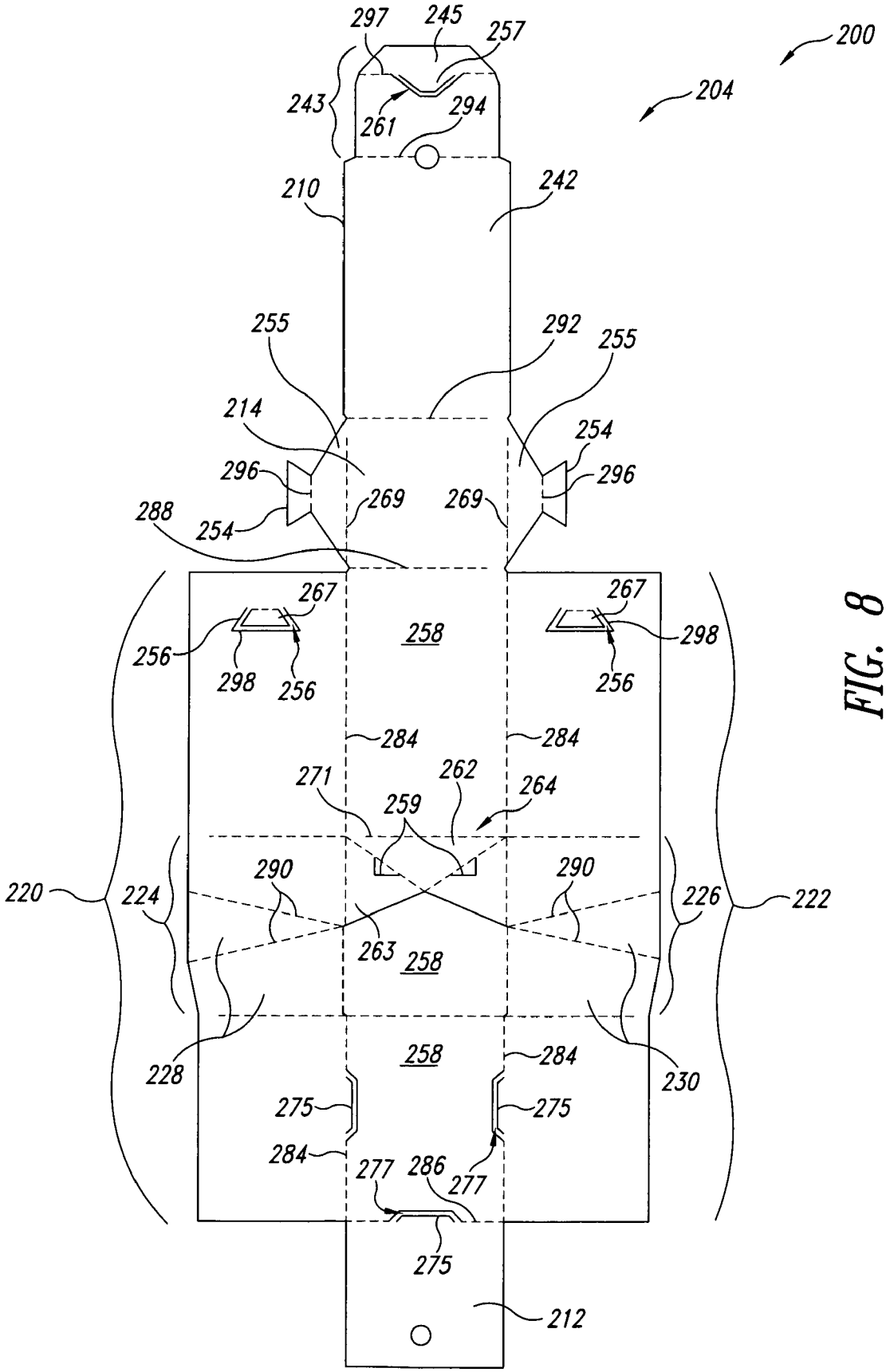
FIG. 8 is a plan view of an inner case blank for forming an inner case member of a container according to one embodiment.

According to another embodiment, a container blank 200 comprises an outer case blank 202 and an inner case blank 204 as illustrated in FIGS. 7 and 8. FIG. 7 illustrates the outer case blank 202 of a container blank 200 from which a user can form the container 100 for tie-less securing and transport of contents, discussed above. The outer case blank 202 is configured to form the outer case member 102. The outer case blank 202 comprises a plurality of side panels 206 configured to form the first interior 108, discussed above. To form the first interior 108, in one embodiment, the plurality of side panels 206 are configured to fold or pivot about a plurality of side panel fold lines 266 and couple to or engage adjacent side panels 206 through coupling features 268.

For example, the plurality of side panels 206 include first and second side panels 270, 272, respectively having first and second elongated tabs 274, 276. Furthermore, the first and second side panels 270, 272 include first and second recessed portions 278, 280, respectively. When the outer case blank 202 forms the outer case member 102, the first and second side panels 270, 272 of the outer case blank 202 cooperate to form one of the side panels 106 of the outer case member 102. The first elongated tab 274 overlaps the second recessed portion 280 and the second elongated tab 276 overlaps the first recessed portion 278, an interaction between the first and second elongated tabs 274, 276 with the second and first recessed portions 280, 278, respectively, creating a leverage, which couples the first and second side panels 270, 272 and maintains a shape and position of the resulting side panel 106 of the outer box member 102. An adhesive or other attaching device, member, compound or other attribute can also be used to assist in coupling the first and second side panels 270, 272.

The outer case blank 202 further includes a first closure panel 210, which is configured to pivot with respect to at least one of the side panels 206 about a fold line 282 positioned therebetween. When the outer case blank 202 forms the outer case member 102, the first closure panel 210 of the outer case blank 202 forms the first closure panel 110 of the outer case member 102.

The first closure panel 210 may include an extension flap 211 having a coupling member 215 and a tear strip 217. The extension flap 211 of the outer case blank 202 is configured to form the extension flap 111. The tear strip 217 may comprise a feature 213 such as perforations, a plurality of cut lines, fold lines, creases, any combination thereof and/or any other feature configured to assist a user in separating the extension flap 211. The coupling member 215 can comprise hook and loop fasteners, adhesives, magnets, any combination thereof, or any other component, device, compound, and/or attribute that promotes engagement of the extension flap 111 to one of the first and second side panels 120, 122, when the outer box member 102 is formed, as illustrated in FIG. 3. In embodiments where the coupling member 215 includes adhesive, the adhesive can include a double-sided adhesive, a temporary adhesive and/or a temperature sensitive adhesive.

As illustrated in FIG. 8, the container blank 200 also includes an inner case blank 204 configured to form the inner case member 104 of the container 100 discussed in the embodiment above. The inner case member 204 includes a base panel 212, a top panel 214, a rear panel 258 and first and second side panels 220, 222, configured to form the second interior 118 of the inner case member 104.

The side panels 220, 222 are configured to fold or pivot about side panel fold lines 284, the base panel 212 is configured to fold or pivot about a base panel fold line 286 and the top panel 214 is configured to fold or pivot about a top panel fold line 288 to form the second interior 118 of the inner case member 104.

The first side panel 220 includes a first intermediate section 224 and the second side panel 222 includes a second intermediate section 226. Furthermore, the first and second intermediate sections 224, 226 are positioned between opposing longitudinal ends of the first and second side panels 220, 222, respectively. The first and second intermediate sections 224, 226 are configured to collapse toward each other when the inner case blank 204 forms the inner case member 104. At least a portion of the first and second intermediate sections 224, 226 are configured to fold or pivot about intermediate section fold lines 290.

As illustrated in FIG. 8, in one embodiment, the first side panel 220 is positioned laterally opposing the second side panel 222, and the first intermediate section 224 is positioned substantially laterally opposing the second intermediate section 226. In one embodiment, a collapsible portion 228 of the first intermediate section 224 is positionable adjacent a collapsible portion 230 of the second intermediate section 226, the collapsible portions 228, 230 being configured to divide the second interior 118 into the first and second volumes 132, 134 when the first and second intermediate sections 224, 226 at least partially fold or pivot about the intermediate section fold lines 290 to form the collapsed portions 128, 130 of the inner case member 104, discussed above. The collapsible portions 228, 230 also form the boundary 138 of the slot 136 when the inner case blank 204 forms the inner case member 104. In some embodiments, the intermediate section fold lines 290 form a triangular shape.

Forming the inner case member 104 from the inner case blank 204 forms the slot 136, as discussed above, for securing the contents 131 of the container 100, precluding a need for other material or securing members such as tie members. Consequently, the user saves time and money when using the container 200, especially in applications that require forming many containers for shipping items, including fragile items, such as gifts and flowers.

In some embodiments, the inner case member 204 may further comprise a second closure panel 242. In these embodiments, the second closure panel 242 is pivotable with respect to at least one of the top panel 214, base panel 212, and the first and second side panels 220, 221, to form the second closure panel 142 of the inner case member 104, which is configured to pivot between the first and second positions as discussed above. The second closure panel 242 is configured to fold or pivot about a closure panel fold line 292 to form the second closure flap 142 of the inner case member 104.

In addition, the second closure panel 242 may comprise a retaining flap 243 toward a free end thereof, which forms the retaining flap 143 of the inner case member 204, when formed. The retaining flap 243 folds or pivots about a retaining flap fold line 294. Additionally, the retaining flap 243 may comprise a securing tab 245, configured to fold or pivot about tab fold line 297 and lip portion 257, which is separated from the retaining flap 243 along a cut line 261 and also pivotably connected to the retaining flap 242 along a portion of the fold line 297, to further secure the contents 131 as discussed above.

The container blank 200 or portions thereof can be fabricated from any material that is formable and can maintain a shape after being formed, such as corrugated paper, cardboard, plastics, composites, and/or any combination thereof.

Furthermore, the term fold line is used herein and in the claims that follow for clarity of description and is not meant to be used in a limiting sense. Fold lines as used herein includes any feature that is configured to promote partially folding the respective panels discussed herein, with respect to other panels to form the inner and outer case members 102, 104. For example, the fold lines may comprise perforations, at least one crease, cut lines, pre-folded, punched or pressed lines, or any other feature configured to promote folding the respective panels with respect to the other panels.

In some embodiments, at least one of the panels of the inner case blank 204 may comprise fastening protrusions 254 on opposing sides thereof. Each fastening protrusion 254 is configured to fold about respective protrusion fold lines 296 to engage a complementary receptacle 256 formed in at least two adjacent panels, thereby coupling the at least one side panel to the at least two adjacent panels and maintaining a shape of a portion of the inner case member 104, when formed. Furthermore, in one embodiment, the receptacles 256 are formed by breached portions 298 of the adjacent panels, respectively. The breached portions 298 may comprise perforations, cut lines, or any other feature partially breaching the adjacent panels, such that the breached portions 298 form flaps 267, respectively. The flaps 267 are configured to fold or pivot about an unbreached boundary thereof and substantially separate at the breached portions 298 to form the receptacles 256. In such an embodiment, the fastening protrusions 254 penetrate at least a portion of the receptacles 256 and secure in place between a penetrated edge of the receptacles 256 and at least a portion of the flaps 267, respectively.

For example, the top panel 214 can comprise the fastening protrusion 254 engaging the complementary receptacle 256 in adjacent first and second side panels 220, 221, when formed. In some embodiments, the fastening protrusions 254 couple to the top panel 214 via a flap 255, which is configured to fold or pivot about the flap fold line 269, aligning the fastening protrusions 254 with the receptacles 256, when the inner case blank 204 forms the inner case member 104.

The rear panel 258 is coupled on opposing lateral sides thereof to the first and second side panels 220, 222. The rear panel 258 includes a third intermediate section positioned between longitudinal ends thereof and longitudinally proximate the first and second intermediate sections 224, 226. The third intermediate section includes a first portion 262, which is configured to fold over a second portion 264, pivoting about a third intermediate section fold line 271, and a third portion 263 configured to fold over the first portion 262, pivoting about slit lines 259, to form the stiffened portion of the third side panel 158 proximate the slot 136, as discussed above.

In some embodiments, the inner case blank 200 includes tabs 275 separated from the inner case blank 200 about a portion of a periphery thereof at cut lines 277. When the side panels 220, 222 and base panel 212 fold or pivot about side panel fold lines 284 and base panel fold line 286, respectively, the tabs 275 erect, extending beyond the rear panel 158 of the formed inner case member 104, to form the raising members 175 described in detail above.

Although embodiments of the present invention have been described with respect to a two-piece container and container blank, one of ordinary skill in the art will appreciate that the present invention is not limited in scope to two pieces. For example, another embodiment of the present invention may comprise a one-piece container or container blank with the outer case member 102 or blank 202 pivotably connected to the inner case member 104 or blank 204, respectively. Furthermore, in another embodiment, a one-piece container may simply comprise first and second sides having features described in conjunction with the first and second sides 120, 122 of the inner case member 104. Yet other embodiments may include an insert having features described in conjunction with the inner case member 104.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A container comprising:

an outer case member comprising a first plurality of panels forming a first interior; and an inner case member positionable within the first interior and comprising a second plurality of panels forming a second interior, the second plurality of panels including at least first and second side panels, the first side panel having a first intermediate section positioned between opposing longitudinal ends of the first side panel, and the second side panel having a second intermediate section positioned between opposing longitudinal ends of the second side panel, the first and second intermediate sections being configured to collapse toward each other, a collapsed portion of the first intermediate section being positioned adjacent a collapsed portion of the second intermediate section forming a wedge-shaped slot therebetween, the slot dividing the second interior into first and second volumes, a boundary of the slot being formed by the adjacent collapsed portions.

2. The container of claim 1 wherein the slot tapers from a wide end of the slot positioned adjacent a free end of the first and second side panels toward a narrow end of the slot positioned toward a rear panel of the inner case member.

3. The container of claim 2 wherein a plane bounded by the boundary of the slot is substantially perpendicular to the rear panel.

4. The container of claim 1, wherein the boundary of the slot includes inward most ends of the collapsed portions of the first and second intermediate sections, respectively, the slot being formed between the inward most ends.

5. The container of claim 1 wherein at least a portion of the boundary of the slot is configured to contact a portion of contents when the contents are placed in the inner case member.

6. The container of claim 1 wherein the second side panel is positioned laterally opposing the first side panel and the second intermediate section is positioned substantially laterally opposing the first intermediate section.

7. The container of claim 1 wherein the first and second intermediate sections each comprise at least one feature configured to facilitate the collapse of the first and second intermediate sections, the at least one feature of the first intermediate section forming a border of a first triangular section and the at least one feature of the second intermediate section forming a border of a second triangular section, the first and second intermediate sections folding at the borders of the first and second triangular sections, at least a portion of the borders of the first and second triangular sections forming the boundary of the slot.

8. The container of claim 7 wherein the first and second side panels each include a free end extending between the opposing longitudinal ends, a portion of the free end of the first and second side panels forming a side of the first and second triangular sections, respectively.

9. The container of claim 7 wherein the at least one feature includes at least one of a fold line, a crease, a plurality of cut lines, and a perforated pattern.

10. The container of claim 1 wherein the inner case member farther includes a rear panel coupled to the first and second side panels wherein a first portion of the rear panel folds over a second portion thereof, stiffening the rear panel in an area proximate the slot.

11. The container of claim 10 wherein a third portion of the rear panel folds over the first portion in an opposite direction to a direction in which the first portion folds over the second portion, further stiffening the rear panel in the area proximate the slot.

12. The container of claim 1 wherein at least one of the outer case member and the inner case member is fabricated from a corrugated material.

13. The container of claim 1 wherein at least one of the outer case member and the inner case member is fabricated from at least one of cardboard, plastic, and a composite.

14. The container of claim 1 wherein the outer case member further includes a first closure panel pivotable with respect to at least one of the first plurality of panels between a first position in which the first closure panel closes at least one of the first and second volumes, and a second position in which the first closure panel opens at least one of the first and second volumes when the inner case member is positioned in the first interior.

15. The container of claim 14 wherein the first closure panel includes a coupling member configured to maintain the first closure panel in the first position.

16. The container of claim 15 wherein the coupling member includes a tear strip configured to separate at least a portion of the closure panel, allowing the first closure panel to pivot to the second position.

17. The container of claim 15 wherein the coupling member comprises hook and loop fasteners.

18. The container of claim 15 wherein the coupling member comprises an adhesive.

19. The container of claim 18 wherein the adhesive includes at least one of a double-sided adhesive, a temporary adhesive and a temperature sensitive adhesive.

20. The container of claim 1 wherein the inner case member comprises a second closure panel pivotable with respect to at least one of the second plurality of panels between a first position in which the second closure panel closes at least a portion of the second interior and at least a second position in which the second closure panel opens the portion of the second interior.

21. The container of claim 20 wherein the second closure panel closes at least one of the first and second volumes, when the second closure panel is in the first position.

22. The container of claim 20 wherein the second closure panel comprises a retaining flap pivotably connected to the second closure panel, the retaining flap being configured to extend into the second interior and position adjacent the collapsed portions, when the second closure panel is in the first position.

23. The container of claim 22 wherein the second closure panel includes a securing tab pivotably connected to the retaining flap and forming a barrier configured to rest against and bias contents in the slot, when the contents are placed in the inner case member and the second closure panel is in the first position.

24. The container of claim 23 wherein the securing tab is pivotably connected to the retaining flap along a laterally extending fold line, and the second closure panel further includes a lip portion adjacent the fold line and positioned on a side of the fold line opposing the securing tab, the lip portion erecting in response to the pivoting of the securing tab with respect to the retaining flap, the lip portion forming a portion of the barrier, when the second closure panel is in the first position.

25. The container of claim 1 wherein at least one of the second plurality of panels comprises a fastening protrusion being configured to engage a complementing recess or opening formed on an adjacent one of the second plurality of panels.

26. The container of claim 1 wherein the inner case member further comprises a rear panel coupled to the first and second side panels, and at least two raising tabs connected to at least one of the second plurality of panels, and extending beyond the rear panel, the raising tabs configured to rest against a surface and raise one of the first and second volumes with respect to the other of the first and second volumes to promote a straight posture of the contents.

27. A container comprising:

first and second side panels, the first side panel having a first intermediate section positioned between opposing longitudinal ends thereof, and the second side panel having a second intermediate section positioned between opposing longitudinal ends thereof, the first and second intermediate sections being configured to collapse toward each other, a collapsed portion of the first intermediate section being positioned adjacent a collapsed portion of the second intermediate section forming a wedge-shaped slot therebetween, a boundary of the slot being formed by the adjacent collapsed portions.

28. The container of claim 27 wherein the slot tapers from a wide end of the slot positioned adjacent a free end of the first and second side panels, toward a narrow end of the slot positioned toward a rear panel of the inner case member.

29. The container of claim 27, further comprising:

a rear panel coupled to the first and second side panels, the rear panel having a stiffened portion in an area proximate the slot.

30. The container of claim 27 wherein a plurality of panels including the first and second side panels form an interior and the slot divides the interior into two volumes.

31. The container of claim 30, further comprising:

a closure panel pivotable with respect to at least one of the plurality of panels between a first position in which the closure panel closes at least one of the first and second volumes and at least a second position in which the closure panel opens the at least one of the first and second volumes.

32. The container of claim 31 wherein the closure panel comprises a retaining flap pivotably connected to the closure panel, the retaining flap being configured to extend into the interior and position adjacent the collapsed portions.

33. The container of claim 32 wherein the closure panel comprises a securing tab pivotably connected to the retaining flap, the securing tab forming a barrier configured to rest against and bias the contents into the slot, when the closure panel is in the first position.

34. The container of claim 33 wherein the securing tab is pivotably connected to the retaining flap along a laterally extending fold line, and the second closure panel further includes a lip portion adjacent the fold line and positioned on a side of the fold line opposing the securing tab, the lip portion erecting in response to the pivoting of the securing tab with respect to the retaining flap, the lip portion forming a portion of the baffler, when the second closure panel is in the first position.

* * * * *